US011484781B2

(12) United States Patent
Brown

(10) Patent No.: US 11,484,781 B2
(45) Date of Patent: Nov. 1, 2022

(54) TEAM TRACKING KITS AND ASSOCIATED METHODS

(71) Applicant: NKB Creative Designs, Inc., Marysville, WA (US)

(72) Inventor: Nicole Brown, Kirkland, WA (US)

(73) Assignee: NKB Creative Designs, Inc., Marysville, WA (US)

( * ) Notice: Subject to any disclaimer, the term of this patent is extended or adjusted under 35 U.S.C. 154(b) by 1068 days.

(21) Appl. No.: 16/135,067

(22) Filed: Sep. 19, 2018

(65) Prior Publication Data

US 2019/0015737 A1 Jan. 17, 2019

Related U.S. Application Data

(63) Continuation of application No. 15/430,689, filed on Feb. 13, 2017, now abandoned.

(51) Int. Cl.

| | |
|---|---|
| ***A63F 11/00*** | (2006.01) |
| ***A63H 37/00*** | (2006.01) |
| *A44C 15/00* | (2006.01) |
| *A44C 25/00* | (2006.01) |
| *A44C 11/00* | (2006.01) |

(52) U.S. Cl.

CPC ..... *A63F 11/0051* (2013.01); *A63H 37/00* (2013.01); *A44C 11/002* (2013.01); *A44C 15/004* (2013.01); *A44C 25/007* (2013.01); *A63F 2250/128* (2013.01)

(58) Field of Classification Search

CPC ..... A63F 11/0051; A63F 2250/128; A63H 37/00; A44C 11/002; A44C 15/004; A44C 25/007; A63B 71/06; A63B 71/0672; A63B 57/00

See application file for complete search history.

(56) References Cited

U.S. PATENT DOCUMENTS

| | | | | |
|---|---|---|---|---|
| 1,454,013 A | | 5/1923 | Boulton | |
| 1,567,021 A | * | 12/1925 | Detlefsen | A44C 15/005 434/245 |
| 4,210,093 A | * | 7/1980 | Baker | A63B 71/0672 273/DIG. 26 |
| 4,912,307 A | * | 3/1990 | Shade | G06C 1/00 235/1 B |
| 5,090,735 A | | 2/1992 | Meaney et al. | |
| 6,185,746 B1 | | 2/2001 | Scott | |

(Continued)

OTHER PUBLICATIONS

International Searching Authority, "International Search Report and Written Opinion," for application No. PCT/US2018/017740, dated Jun. 29, 2018.

*Primary Examiner* — Michael D Dennis
(74) *Attorney, Agent, or Firm* — MacMillan, Sobanski & Todd, LLC

(57) ABSTRACT

Team tracking kits, methods of using a team tracking kits, and methods or providing team tracking kits are described. An example embodiment of a team tracking kit includes an elongate member, a first token, and a first plurality of tokens. The first token includes a representation of a first team. Each token of the first plurality of tokens includes a representation of a rival team, a representation of an event within a postseason within which the first team can participate, or a representation of an event within a tournament within which the first team can participate.

18 Claims, 8 Drawing Sheets

(56) References Cited

U.S. PATENT DOCUMENTS

D474,872 S 5/2003 Sullivan
6,854,417 B2 2/2005 Stephens
D517,443 S 3/2006 Dennis
7,287,781 B1 10/2007 Hathaway
7,725,955 B1 6/2010 Johnson
2001/0043664 A1* 11/2001 Grant ..... G06C 1/00 377/24.2
2002/0095952 A1 7/2002 Kelly
2005/0005644 A1 1/2005 Ho
2005/0026122 A1 2/2005 House
2005/0108809 A1 5/2005 Kronenberger
2005/0166636 A1* 8/2005 Lazor ..... A44C 5/0007 63/38
2006/0248922 A1 11/2006 Scharr
2007/0059673 A1* 3/2007 Charles ..... G16H 20/60 434/203
2007/0131753 A1* 6/2007 Myers ..... A63B 71/06 235/123
2007/0261441 A1* 11/2007 Fouzailov ..... A44C 25/007 63/40
2008/0050708 A1 2/2008 Rodriguez et al.
2008/0148626 A1* 6/2008 Brunelle ..... C10L 1/328 44/281
2009/0007597 A1 1/2009 Hanevold
2010/0184007 A1* 7/2010 Compton ..... G09B 19/22 434/128
2010/0240510 A1 9/2010 Greenberg Abrahami et al.
2010/0307035 A1 12/2010 Malone
2011/0146345 A1* 6/2011 Roessler ..... A44C 25/007 63/1.11
2012/0226555 A1 9/2012 Christian
2014/0185416 A1* 7/2014 Sanchez ..... G09B 23/28 368/10
2017/0231333 A1 8/2017 Giammarco

* cited by examiner

TEAM TRACKING KITS AND ASSOCIATED METHODS

RELATED APPLICATION

This application is a continuation of U.S. application Ser. No. 15/430,689, filed on Feb. 13, 2017. The entire disclosure of this related application is hereby incorporated into this disclosure by reference.

FIELD

The disclosure relates generally to the field of tracking the outcome of events, such as sporting events. More particularly, the disclosure relates to team tracking kits and associated methods.

BACKGROUND

Individuals interested in events, such as sporting events, sometimes collect and display memorabilia that relates to a specific sport, team, or player. For example, these individuals regularly monitor the number of events won or lost by a specific athletic team and record these statistics by hand on various items, such as within a program or on a poster or t-shirt. Each of these methods, however, requires the individual to create a written record of the events on the item, which can be burdensome and aesthetically unpleasing when it is desired to publically display the record.

Therefore, a need exists for new and useful kits and methods for tracking the outcome of various events relating to a team.

SUMMARY OF SELECTED EXAMPLE EMBODIMENTS

Various team tracking kits and associated methods are described herein.

An example team tracking kit includes an elongate member, a first token, and a first plurality of tokens. The first token is attachable to the elongate member and includes a representation of a first team. Each token of the first plurality of tokens is attachable to the elongate member and includes a representation of a rival team that is different than the first team. Each token of the first plurality of tokens has a distinct representation of a rival team relative to the other tokens of the first plurality of tokens. Each representation of the rival team relates to a rival team the first team will encounter during a season.

Another example team tracking kit includes an elongate member, a first token, and a championship token. The first token is attachable to the elongate member and includes a representation of a first team. Each token of the first plurality of tokens is attachable to the elongate member and includes a representation of the first team and a representation of an event within a postseason within which the first team can participate. Each token of the first plurality of tokens has a distinct representation of an event within a postseason relative to the other tokens of the first plurality of tokens. The championship token is attachable to the elongate member and includes a representation of the first team and a representation of a title.

Another example team tracking kit includes an elongate member, a first token, a first plurality of tokens, and a championship token. The first token is attachable to the elongate member and includes a representation of a first team. Each token of the first plurality of tokens is attachable to the elongate member and includes a representation of the first team and a representation of an event within a tournament within which the first team can participate. Each token of the first plurality of tokens has a distinct representation of an event within the tournament relative to the other tokens of the first plurality of tokens. The championship token is attachable to the elongate member and includes a representation of the first team and a representation of a title.

An example method of using a team tracking kit comprises the steps of: obtaining a team tracking kit, the team tracking kit includes an elongate member, a first token, and a first plurality of tokens; attaching the first token to the elongate member; obtaining the results of a first event within which the first team was involved; if the first team won the first event, attaching a first token of the first plurality of tokens to the elongate member; if the first team lost the first event, discarding the first token of the first plurality of tokens; waiting for an interval of time to pass; obtaining the results of second event within which the first team was involved; if the first team won the second event, attaching a second token of a first plurality of tokens to the elongate member; if the first team lost the second event, discarding the second token of the first plurality of tokens; placing the elongate member around the neck of an individual; attaching the elongate member to the individual.

An example method of providing a team tracking kit comprises the steps of: receiving an order to purchase a team tracking kit, the team tracking kit includes an elongate member, a first token, and a first plurality of tokens; providing the team tracking kit to a user; instructing the user to attach the first token to the elongate member; instructing the user to obtain the results of a first event within which the first team was involved; if the first team won the first event, instructing the user to add a first token of the first plurality of tokens to the elongate member; if the first team lost the first event, instructing the user to discard the first token of the first plurality of tokens; instructing the user to wait for an interval of time to pass; instructing the user to obtain the results of a second event within which the first team was involved; if the first team won the second event, instructing the user to add a second token of the first plurality of tokens to the elongate member; if the first team lost the second event, instructing the user to discard the second token of the first plurality of tokens; placing the elongate member around the neck of an individual.

Additional understanding of the example team tracking kits and methods of using a team tracking kit can be obtained by review of the detailed description, below, and the appended drawings.

DETAILED DESCRIPTION

The following detailed description and the appended drawings describe and illustrate various example embodiments of team tracking kits, methods of using a team tracking kit, and methods of providing a team tracking kit. The description and illustration of these examples are provided to enable one skilled in the art to make and use a team tracking kit, to practice a method of using a team tracking kit, and to practice a method of providing a team tracking kit. They are not intended to limit the scope of the claims in any manner.

As used herein, the term "diameter" refers to the length of a straight line passing from side to side through the center of a body, element, or feature, and does not impart any structural configuration on the body, element, or feature.

As used herein, the term "team" refers to an individual, or a group of individuals, that takes part in an event (e.g., a contest, athletic contest, game).

As used herein, the term "discard" refers to throwing an element in the trash or otherwise not using an element provided in a team tracking kit.

As used herein, the term "postseason" refers to an event (e.g., contest, athletic contest, game) that is scheduled after a regular season and that requires qualification for entry, or to a series of events (e.g., series of contests, series of athletic contests, series of games) that are scheduled after a regular season and that require qualification for entry.

Figure 1:
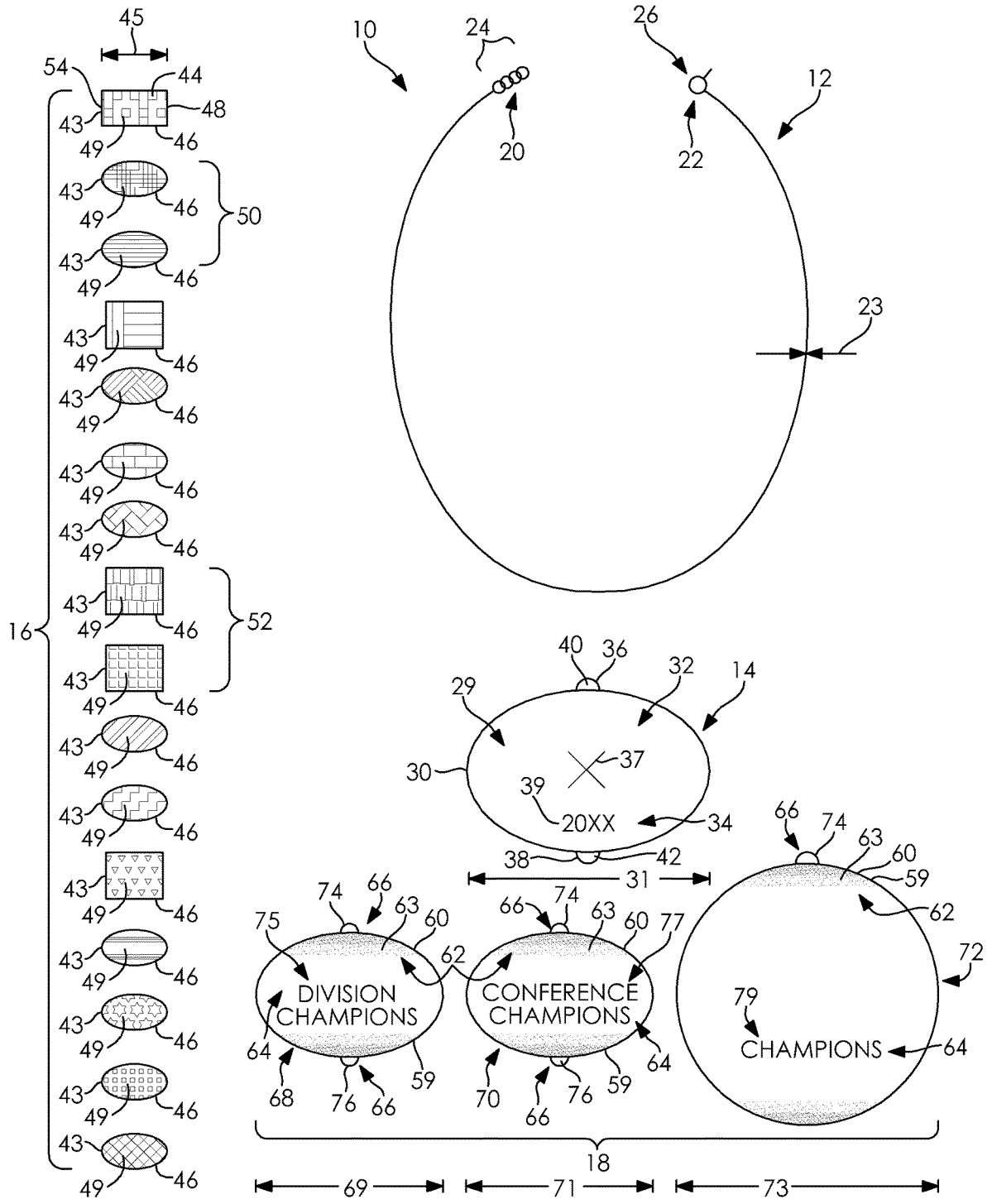
FIG. 1 is a top view of an example team tracking kit.

FIG. 1 illustrates a first example team tracking kit 10. The team tracking kit 10 includes an elongate member 12, a first token 14, a first plurality of tokens 16, and a second plurality of tokens 18. In the illustrated embodiment, the team tracking kit 10 relates to a season and a postseason of a first team that will be completed in the future, is currently in progress, or that has already been completed.

The elongate member 12 has a first end 20, a second end 22, a length that extends from the first end 20 to the second end 22, and an outside diameter 23. In the illustrated embodiment, the elongate member 12 has a length that is sized and configured such that the elongate member 12 can be positioned around a portion of the body of a user (e.g., neck, wrist, finger) of the team tracking kit 10. The elongate member 12 includes structure that allows a first portion of the elongate member 12 (e.g., first end 20) to be attached to a second portion of the elongate member 12 (e.g., second end 22) to achieve attachment of the elongate member 12 around the portion of the body of the user (e.g., neck, wrist, finger) of the team tracking kit 10. In the illustrated embodiment, a portion of the length of the elongate member 12 that extends from the first end 20 towards the second end 22 defines a series of loops 24 and the second end 22 includes a clasp 26. Each loop of the series of loops 24 is sized and configured to receive a portion of the clasp 26 to achieve releasable attachment of the second end 22 of the elongate member 10 within a loop of the series of loops 24.

While the elongate member 12 has been illustrated as including a series of loops 24 and a clasp 26, an elongate member can include any structure capable of providing attachment between a first portion of the elongate member and a second portion of the elongate member. Selection of suitable structure to include on an elongate member can be based on various considerations, including the material that form the elongate member. Examples of structures considered suitable to include on an elongate member to achieve attachment between a first portion of the elongate member and a second portion of the elongate member include clasps, such as lobster clasps, spring ring clasps, hook and eye clasps, fasteners, magnets, and any other structure considered suitable for a particular embodiment. Alternatively, a first portion of an elongate member (e.g., first end, portion of the length of an elongate member that extends from the first end towards the second end) can be tied to a second portion of an elongate member (e.g., second end, portion of the length of an elongate member that extends from the second end towards the first end) to achieve attachment around a portion of a user's body (e.g., neck, wrist, finger). Alternatively, an elongate member can be formed as a single continuous piece of material to which a token, or a plurality of tokens is attached.

The elongate member 12 can have any suitable structural arrangement and be formed of any suitable material and selection of a suitable structural arrangement and material to form an elongate member can be based on various considerations, including the material that forms a first token included in a team tracking kit within which the elongate member is included. Examples of structural arrangements considered suitable to form an elongate member include necklaces, bracelets, or rings formed of cables, boxes, curbs, ropes, double ropes, herringbones, and any other structural arrangement considered suitable for a particular embodiment. Examples of materials considered suitable to form an elongate member include metals (e.g., solid, plated, filled, filigreed), plastics, acrylic, glass, wood, fabrics, combinations of the materials described herein, and any other material considered suitable for a particular embodiment.

The first token 14, each token in the first plurality of tokens 16, and each token in the second plurality of tokens 18 included in a team tracking kit 10 can have any suitable size and structural arrangement and selection of a suitable size and structural arrangement to form a token can be based on various considerations, including the structural arrangement of an elongate member included in a team tracking kit within which the token is included. Examples of structural arrangements considered suitable to form a token include lentils, disks, medallions, beads, arrangements in which the token is configured as an implement used in the execution of any event (e.g., football, basketball, hockey, soccer, track, gymnastics, rugby, lacrosse) at any level (e.g., professional, collegiate, high school, junior high school), such as helmets, bats, hockey sticks, footballs, soccer balls, rugby balls, structures that identify a team (e.g., a three dimensional (3-D) representation of a team), such as logos, designs, colors, combination of colors, those that are customized, ovoid, and/or tubular, combinations of those described herein, and any other structural arrangement considered suitable for a particular embodiment.

In the illustrated embodiment, the first token 14 is attachable to the elongate member 12, is sized and configured such that it can be releasably disposed on the elongate member 12, and is formed as a medallion 29. The first token has a main body 30, an outside diameter 31, a representation of a first team 32, a representation of a season 34, structure 36 for attaching the first token 14 to the elongate member 12, and structure 38 for attaching a token of the second plurality tokens to the first token 14.

The representation of the first team 32 can include any suitable structure, element, and/or feature that relates to a team and selection of a suitable structure, element, and/or feature to include on a token to represent a first team can be based on various considerations, including the size and/or configuration of the token on which the representation is intended to be included. Examples of representations of a first team considered suitable to include on a token include monikers, abbreviations, team codes, team names, team nicknames, mascot names, former names of a team, slogans, logos, mascots, designs, colors, combination of colors, structures that identify a team (e.g., a three dimensional (3-D) representation of a team, such as those described herein, a recess that provides a representation of a team as described herein), and any other structure, element and/or feature associated with a team. In the illustrated embodiment, the representation of the first team 32 is a logo 37. The representation of the season 34 can include any suitable structure, element, and/or feature and selection of a suitable structure, element, and/or feature to include on a token to represent a season (e.g., regular season, single season of a sport, single season of a series of events) can be based on various considerations, including the size and/or configuration of the token on which the representation is intended to be included. Examples of suitable representations of a season considered suitable to include on a token include a listing of a year, a month, a day, a combination of a year, a month, and/or a day, monikers, abbreviations, season codes, designs, colors, combination of colors, structures that identify a season, and any other structure, element and/or feature associated with a season. In the illustrated embodiment, the representation of the season 34 is representation of a year 39. A team can be associated with any suitable sport, such as football, basketball, hockey, soccer, track, gymnastics, rugby, lacrosse, and any other sport considered suitable for a particular embodiment.

The representation of a first team 32 (e.g., logo 37) and the representation of the season 34 (e.g., year 39) can be included on a token using any suitable method or technique. Selection of a suitable method or technique to include a representation of a first team and/or a representation of a season can be based on various considerations, including the material that forms the token on which a representation of a first team and/or representation of a season is intended to be included. Examples of methods and techniques considered suitable to include a representation of a first team and/or representation of a season on a token include painting a representation of a first team and/or representation of a season on the token, forming the token such that it defines a representation of a first team and/or representation of a season, placing a sticker that includes a representation of a first team and/or representation of a season on the token, and any other method and/or technique considered suitable for a particular embodiment.

The first token 14 can include any suitable structure 36 for accomplishing attachment to the elongate member 12 and selection of suitable structure to include on a token to accomplish attachment to an elongate member can be based on various considerations, including the material that forms the elongate member to which the token is intended to be attached. Examples of structures considered suitable to include on a token to accomplish attachment to an elongate member include clasps, such as lobster clasps, spring ring clasps, hook and eye clasps, fasteners, forming a passageway through a portion of the token, and any other structure considered suitable for a particular embodiment. In the illustrated embodiment, the structure 36 for attaching the first token 14 to the elongate member 12 is a passageway 40 defined by the main body 30 of the first token 14. The passageway 40 extends through a portion of the first token 14 and is sized and configured to pass over both the first end 20 and the second end 22 of the elongate member 12 and to receive a portion of the elongate member 12. While the first token 14 has been illustrated as separate from the elongate member 12, a team tracking kit can include a first token that is pre-assembled and disposed on the elongate member. While the first token 14 has been illustrated as including structure 36 for accomplishing attachment to the elongate member 12 that is sized and configured to pass over both the first end 20 and the second end 22 of the elongate member 12, a first token can include structure for accomplishing attachment to an elongate member that is sized and configured to pass over one of the first end or the second end of the elongate member, or neither of the first end or second end (e.g., in embodiments in which a clasp is used).

The first token 14 can include any suitable structure 38 for accomplishing attachment of a token of the second plurality of tokens 18 to the first token 14 and selection of suitable structure to include on a token to accomplish attachment to another token can be based on various considerations, including the material that forms the first token. Examples of structures considered suitable to include on a first token include clasps, such as lobster clasps, spring ring clasps, hook and eye clasps, fasteners, forming a passageway through a portion of the token, and any other structure considered suitable for a particular embodiment. In the illustrated embodiment, the structure 38 for attaching a token of the second plurality of tokens 18 to the first token 14 is a second passageway 42 defined by the main body 30 of the first token 14. The second passageway 42 extends through a portion of the first token 14 and is sized and configured to receive a portion of a token of the second plurality of tokens 18.

While the first token 14 has been illustrated as including a representation of a first team 32, a team tracking kit can include a plurality of tokens that each include a representation of a first team and selection of a suitable number tokens to include in a team tracking kit that include a representation of a first team can be based on various considerations, including the number of other tokens intended to be included in a team tracking kit. Examples of suitable numbers of tokens to include in a team tracking kit that include a representation of a first team include one, at least one, two, a plurality, three, four, five, and any other number considered suitable for a particular embodiment.

While the first token 14 has been illustrated as including a single representation of a first team 32 and a single representation of a season 34, a first token can include any suitable number of representations of a first team and/or representations of a season. Selection of a suitable number of representations of a first team and/or representations of a season to include on a token can be based on various considerations, including the material that forms the token. Examples of numbers of representations of a first team and/or representations of a season to include on a token include one, at least one, two, a plurality, three, four, and any other number considered suitable for a particular embodiment. For example, a token can include a representation of a first team and omit a representation of a season or include a representation of a season and omit a representation of a first team.

In the illustrated embodiment, each token of the first plurality of tokens 16 is attachable to the elongate member 12, is sized and configured such that it can be releasably disposed on the elongate member 12, and is formed as a bead 43. Each token of the first plurality of tokens 16 has a main body 44, an outside diameter 45, a representation of a rival team 46 that is different than the representation of the first team 32, and structure 48 for attaching the token to the elongate member 12. Each token of the first plurality of tokens 16 has a distinct representation of a rival team 46 relative to the other tokens included in the first plurality of tokens 16 and relates to a rival team the first team will encounter during a single season (e.g., single season associated with a sport, single season associated with a series of events). In the illustrated embodiment, the outside diameter 45 of each token of the first plurality of tokens 16 is less than the outside diameter 31 of the first token 14.

The representation of a rival team 46 can include any suitable structure, element, and/or feature that relates to a team and selection of a suitable structure, element, and/or feature to include on a token of a first plurality of tokens to represent a rival team can be based on various considerations, including the size and/or configuration of the token on which the representation is intended to be included. Examples of suitable representations of a rival team considered suitable to include on a token include monikers, abbreviations, team codes, slogans, logos, designs, colors, combination of colors, structures that identify a team, and any other structure, element and/or feature associated with a rival team. In the illustrated embodiment, the representation of a rival team 46 included on each token of the first plurality of tokens 16 is a combination of colors 49 associated with a rival team that the first team will encounter (e.g., first token of the first plurality of tokens is blue and red, second token of the first plurality of tokens is blue and yellow, third token of the first plurality of tokens is red and brown, fourth token of the first plurality of tokens is white and blue). Any suitable color, or combination of colors, can be used as a representation of a first team, or rival team, and selection of a suitable color, or combination of colors, can be based on various considerations, including the color(s) associated with the team. Examples of colors, and combination of colors, considered suitable as a representation of a first team and/or a rival team include white, black, blue, blue-green, green, yellow-green, yellow, yellow-orange, orange, red-orange, red, red-violet, violet, blue-violet, any combination of colors described herein, colors associated with a team, combination of colors associated with a team, and any other color or combination of colors considered suitable for a particular embodiment.

In the illustrated embodiment, a first set 50 of tokens of the first plurality of tokens 16 has a first structural arrangement and a second set 52 of tokens of the first plurality of tokens 16 has a second structural arrangement that is different than the first structural arrangement. In the illustrated embodiment, each token in the first set 50 is formed as an ovoid bead and each token in the second set 52 is formed as a tubular bead. The inclusion of a first set of tokens that has a different structural arrangement relative to the structural arrangement of a second set of tokens is considered advantageous at least because it provides a mechanism for distinguishing between different groups (e.g., conferences) of teams the first team may encounter during a season. Each set of tokens included in a plurality of tokens can include any suitable number of tokens, such as one, at least one, two, a plurality, three, four, five, six, seven, eight, nine, ten, more than ten, more than twenty, and any other number of tokens considered suitable for a particular embodiment.

A representation of a rival team (e.g., combination of colors 49 associated with a rival team) and any other representations, such as a representation of a season and/or a representation of a date that relates to the date the first team and the rival team meet, or did meet, can be included on a token of a first plurality of tokens using any suitable method or technique. Selection of a suitable method or technique to include a representation of a rival team, a representation of a season, and/or a representation of a date, can be based on various considerations, including the material that forms the token on which a representation is intended to be included. Examples of methods and techniques considered suitable to include a representation of a rival team, a representation of a season, and/or a representation of a date on a token include painting a representation on the token, forming the token such that it defines a representation, placing a sticker that includes a representation on the token, and any other method and/or technique considered suitable for a particular embodiment.

Each token of the first plurality of tokens 16 can include any suitable structure 48 for accomplishing attachment to the elongate member 12 and selection of suitable structure to include on a token included in a first plurality of tokens can be based on various considerations, including the material that forms the elongate member to which the token is intended to be attached. Examples of structures considered suitable to include on a token to accomplish attachment to an elongate member include clasps, such as lobster clasps, spring ring clasps, hook and eye clasps, fasteners, forming a passageway through a portion of the token, and any other structure considered suitable for a particular embodiment. In the illustrated embodiment, the structure 48 for attaching each token of the first plurality of tokens 16 to the elongate member 12 is a passageway 54 defined by the main body 44 of the token. The passageway 54 extends through a portion of each token of the first plurality of tokens 16 and is sized and configured to pass over both the first end 20 and the second end 22 of the elongate member 12 and to receive a portion of the elongate member 12. While each token of the first plurality of tokens 16 has been illustrated as separate from the elongate member 12, a team tracking kit can include a first plurality of tokens, or a portion of a first plurality of tokens, that is pre-assembled and disposed on the elongate member. While each token of the first plurality of tokens 16 has been illustrated as including structure 48 for accomplishing attachment to the elongate member 12 that is sized and configured to pass over both the first end 20 and the second end 22 of the elongate member 12, a first token can include structure for accomplishing attachment to an elongate member that is sized and configured to pass over one of the first end or the second end of the elongate member, or neither of the first end or second end (e.g., in embodiments in which a clasp is used).

While each token of the first plurality of tokens 16 has been illustrated as including a single representation of a rival team 46, a token can include any suitable number of representations of a rival team, season, and/or a date. Selection of a suitable number of representations of a rival team, season, and/or date to include on a token can be based on various considerations, including the material that forms the token. Examples of numbers of representations of a rival team, season, and/or date to include on a token include one, at least one, two, a plurality, three, four, and any other number considered suitable for a particular embodiment. For example, a token can include a representation of a rival team and omit a representation of a season and/or date, include a representation of a season and omit a representation of a rival team and/or date, include a representation of a date and omit a representation of a rival team and/or season, or include a representation of a rival team, season, and date.

While each token of the first set 50 of the first plurality of tokens 16 has been illustrated as an ovoid bead and each token of the second set 52 of the first plurality of tokens 16 has been illustrated as a tubular bead, a token in a first set of tokens can have any suitable structural arrangement relative to a token in a second set of tokens. Selection of a suitable structural arrangement to form a token in a first set of tokens relative to a token in a second set of tokens can be based on various considerations, including the number of groups of teams that will encounter the first team in a single season. For example, a first set of tokens of a first plurality of tokens can have a first structural arrangement that is the same as, or different than, the structural arrangement of a second set of tokens of the first plurality of tokens.

While the outside diameter 45 of each token of the first plurality of tokens 16 has been illustrated as being less than the outside diameter 31 of the first token 14, a token included in a first plurality of tokens can have any suitable outside diameter relative to a first token. Selection of a suitable size for a token of a first plurality of tokens to have relative to a first token can be based on various considerations, including the structural arrangement of an elongate member and/or a first token included in a kit within which the first plurality of tokens is included. Examples of outside diameters considered suitable for a token of a plurality of tokens to have relative to a first token include outside diameters that are equal to, substantially equal to, greater than, or less than the outside diameter of the first token.

While the first plurality of tokens 16 has been illustrated as including sixteen tokens, a first plurality of tokens can include any suitable number of tokens and selection of a suitable number of tokens to include in a first plurality of tokens can be based on various considerations, including the number of events (e.g., sporting event) within which the first team will play in a single season. Example number of tokens considered suitable to include in a first plurality of tokens include one, at least one, two, a plurality, three, four, five, six, seven, eight, nine, ten, eleven, twelve, thirteen, fourteen, fifteen, sixteen, seventeen, eighteen, nineteen, twenty, more than twenty, more than thirty, more than forty, more than fifty, and any other number considered suitable for a particular embodiment. The number of tokens included in a first plurality of tokens will be based on the number of rivals the first team will face in a single season. Alternatively, a first plurality of tokens can be omitted from a team tracking kit in embodiments in which regular season tracking is not desired.

In the illustrated embodiment, each token of the second plurality of tokens 18 is attachable to the elongate member 12, is sized and configured such that it can be releasably disposed on the elongate member 12, and is formed as a medallion 59. Each token of the second plurality of tokens 18 and has a main body 60, a representation of the first team 62, a representation of a postseason title 64, and structure 66 for attaching the token to another token (e.g., first token 14, a token of the second plurality of tokens), as described in more detail herein. The main body 60 of a first token 68 of the second plurality of tokens 18 has a first outside diameter 69, the main body 60 of a second token 70 of the second plurality of tokens 18 has a second outside diameter 71, and the main body 60 of a third token 72 of the second plurality of tokens 18 has a third outside diameter 73. Each of the first outside diameter 69 and the second outside diameter 71 is less than the outside diameter 31 of the first token 14. The third outside diameter 73 is greater than the outside diameter 31 of the first token 14 and each of the first outside diameter 69 and the second outside diameter 71. The inclusion of a first token 68, a second token 70, and a third token 72 that have different outside diameters (e.g., structural arrangements) is considered advantageous at least because it provides a mechanism for distinguishing between different postseason titles that the first team may, or has, acquire(d).

The representation of the first team 62 can include any suitable structure, element, and/or feature and selection of a suitable structure, element, and/or feature to include on a token to represent a first team can be based on various considerations, including the size and/or configuration of the token on which the representation is intended to be included. Examples of suitable representations of a first team considered suitable to include on a token include monikers, abbreviations, team codes, team names, team nicknames, mascot names, former names of a team, slogans, logos, mascots, designs, colors, combination of colors, structures that identify a team (e.g., a three dimensional (3-D) representation of a team, such as those described herein, a recess that provides a representation of a team as described herein), and any other structure, element and/or feature associated with a team. In the illustrated embodiment, the representation of the first team 62 includes a combination of colors 63 associated with the first team.

Each token of the second plurality of tokens 18 has a distinct representation of a postseason title 64 that directly follows the regular season. The representation of a postseason title 64 can include any suitable structure, element, and/or feature and selection of a suitable structure, element, and/or feature to include on a token to represent a postseason title can be based on various considerations, including the size and/or configuration of the token on which the representation is intended to be included. Examples of suitable representations of a postseason title considered suitable to include on a token include monikers, abbreviations, postseason title codes, slogans, logos, designs, colors, combination of colors, structures that identify a postseason title, and any other structure, element, and/or feature associated with a postseason title. In the illustrated embodiment, the representation of the postseason title 64 included on the first token 68 of the second plurality of tokens 18 is a first title 75 (e.g., division champions), the representation of the postseason title 64 included on the second token 70 of the second plurality of tokens 18 includes a second title 77 (e.g., conference champions), and the representation of the postseason title 64 included on the third token 72 of the second plurality of tokens 18 includes a third title 79 (e.g., champions).

A representation of a first team and a representation of a postseason title, and any other representations, such as a representation of a season and/or date, can be included on a token included in a second plurality of tokens using any suitable method or technique. Selection of a suitable method or technique to include a representation of a team, a postseason title, a season, and/or a date can be based on various considerations, including the material that forms the token on which a representation is intended to be included. Examples of methods and techniques considered suitable to include a representation of a team, a postseason title, a season, and/or a date on a token of a second plurality of tokens include painting a representation on the token, forming the token such that it defines a representation, placing a sticker that includes a representation on the token, and any other method and/or technique considered suitable for a particular embodiment.

Each token of the second plurality of tokens 18 can include any suitable structure 66 for accomplishing attachment to another token (e.g., first token 14) and selection of suitable structure to include on a token included in a second plurality of tokens can be based on various considerations, including the material that forms the token to which the token of the second plurality of tokens is intended to be attached. Examples of structures considered suitable to include on a token included in a second plurality of tokens to accomplish attachment to another token include clasps, such as lobster clasps, spring ring clasps, hook and eye clasps, fasteners, forming a passageway through a portion of the first token, and any other structure considered suitable for a particular embodiment. In the illustrated embodiment, the structure 66 for attaching each token of the second plurality of tokens 18 to the elongate member 12 is a clasp 74. In addition, the main body 60 of each of the first token 68 and the second token 70 of the second plurality of tokens 18 defines a passageway 76 that extends through a portion of the token and is sized and configured to receive a clasp, or other structure, for accomplishing attachment to another token. While each token of the second plurality of tokens 18 has been illustrated as separate from the elongate member 12, a team tracking kit can include a second plurality of tokens, or a portion of a second plurality of tokens, that is pre-assembled and disposed on an elongate member. While each token of the second plurality of tokens 18 has been illustrated as including structure 66 for accomplishing attachment to another token, a token included in a second plurality of tokens can include structure for accomplishing attachment to an elongate member (e.g., passageway) that is sized and configured to pass over both, one, or neither, of the first end or the second end of the elongate member.

While each token of the second plurality of tokens 18 has been illustrated as including both a representation of the first team 62 and a representation of a postseason title 64, a token can include any suitable number of representations of a team and/or postseason title, and any other representations, such as representations of a season and/or a date that relates to the date the first team played the postseason event. Selection of a suitable number of representations of a team, a postseason title, season, and/or date to include on a token can be based on various considerations, including the material that forms the token. Examples of numbers of representations of a team, a postseason title, season, and/or date to include on a token include one, at least one, two, a plurality, three, four, and any other number considered suitable for a particular embodiment. For example, a token can include a representation of a team and omit a representation of a postseason title, a season, and/or date, include a representation of a postseason title and omit a representation of a team, a season, and/or date, include a representation of a season and omit a representation of a team, a postseason title, and/or date, include a representation of a date and omit a representation of a team, a postseason title, and/or season, or include a representation of a season, a team, a postseason title, and/or date.

While the first outside diameter 69 and the second outside diameter 71 have been illustrated as being less than the outside diameter 31 of the first token 14 and the third outside diameter 73 has been illustrated as being greater than the outside diameter 31 of the first token 14, a token included in a second plurality of tokens can have any suitable outside diameter relative to a first token or to other tokens in the second plurality of tokens. Selection of a suitable size for a token of a second plurality of tokens to have relative to a first token or other tokens in the second plurality of tokens can be based on various considerations, including the material that forms an elongate member and/or a first token. Examples of diameters considered suitable for a token of a second plurality of tokens include diameters that are equal to, substantially equal to, less than, and greater than the diameter of the first token.

While the second plurality of tokens 18 has been illustrated as including three tokens, a second plurality of tokens can include any suitable number of tokens and selection of a suitable number of tokens to include in a second plurality of tokens can be based on various considerations, including the number of postseason events (e.g., sporting events, games) within which the first team can play during a postseason. Example number of tokens considered suitable to include in a second plurality of tokens include one, at least one, two, a plurality, three, four, five, six, seven, eight, nine, ten, more than ten, more than twenty, and any other number considered suitable for a particular embodiment. Alternatively, a second plurality of tokens can be omitted from a team tracking kit in embodiments in which postseason tracking is not desired.

The first token 14, each token of the first plurality of tokens 16, and each token of the second plurality of tokens 18 can be formed of any suitable material and selection of a suitable material to form a token can be based on various considerations, including the material that forms an elongate member of a team tracking kit within which the token is included. Examples of materials considered suitable to form a token include metals (e.g., solid, plated, filled, filigreed), plastics, acrylic, glass, wood, fabrics, pearls, gems, shells, combinations of the materials described herein, and any other material considered suitable for a particular embodiment.

Figure 2:
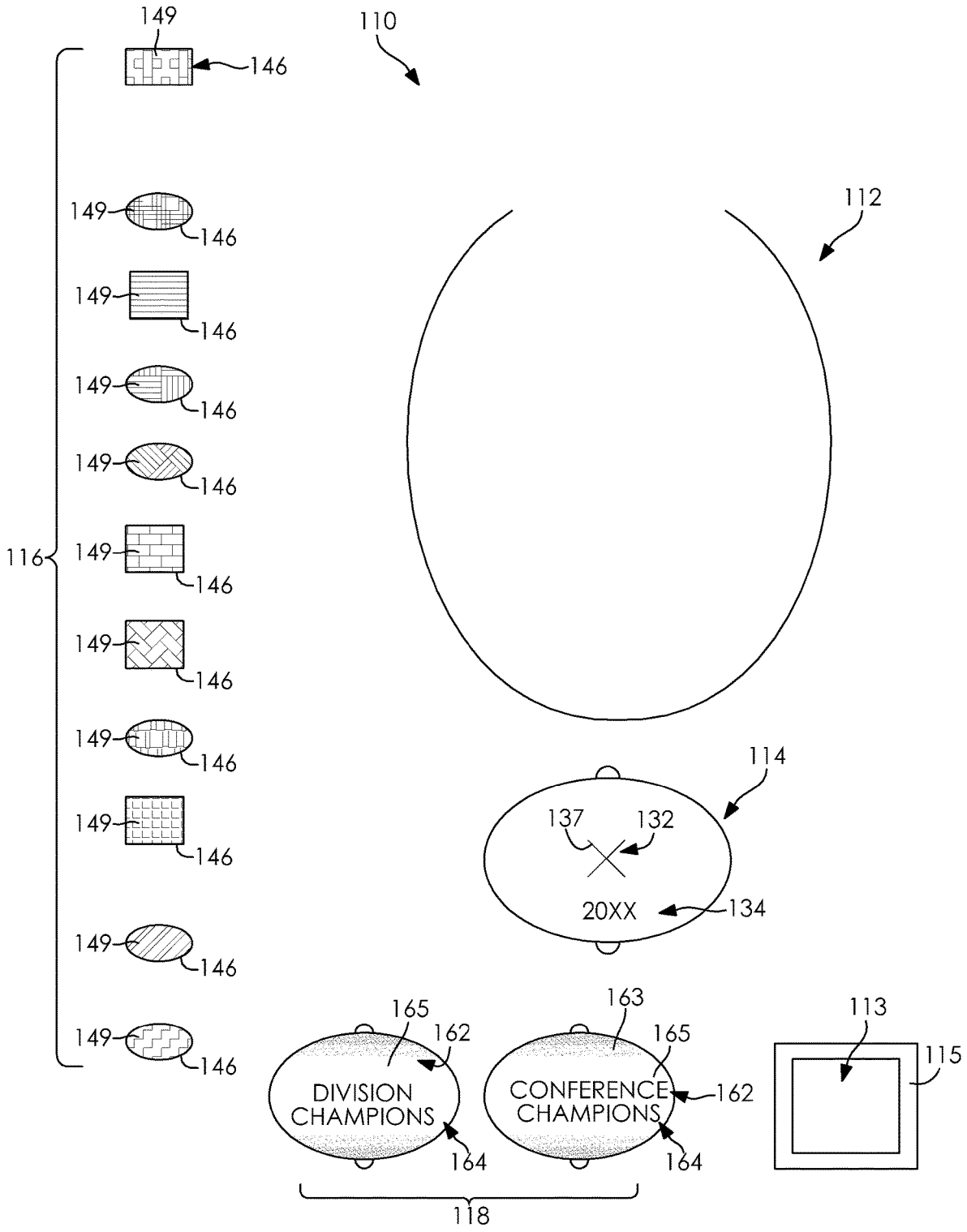
FIG. 2 is a top view of a second example team tracking kit.

FIG. 2 illustrates another team tracking kit 110. The team tracking kit 110 is similar to the team tracking kit 10 illustrated in FIG. 1 and described above, except as detailed below. The team tracking kit 110 includes an elongate member 112, a storage container 113, a first token 114, a first plurality of tokens 116, and a second plurality of tokens 118. In the illustrated embodiment, the team tracking kit 110 relates to the outcome of a season and postseason of a first team. However, alternative embodiments of a team tracking kit can relate to only the outcome of a season or postseason.

In the illustrated embodiment, the elongate member 112 omits the inclusion of a series of loops and a clasp, the first token 114 includes a representation of a first team 132 and a representation of a season 134, each token of the first plurality of tokens 116 includes a representation of a rival team 146 that is different than the representation of the first team 132 and that the first team beat during an event, and each token of the second plurality of tokens 118 includes a representation of the first team 162 and a representation of a postseason title 164 that the first team obtained. In the illustrated embodiment, the representation of the first team 132 is a logo 137 of the first team, the representation of a rival team 146 included on each token of the first plurality of tokens 116 includes a combination of colors 149 associated with a rival team that the first team encountered during a season and beat, the representation of the first team 162 includes a combination of colors 163 associated with the first team, and the representation of a postseason title 170 includes the name 165 of the postseason title.

Since the team tracking kit 110 relates to the outcome of a season and postseason of a first team, additional representations of information can be provided on any token. For example, a first token can include a representation of the first team's overall record during the season and/or postseason, each token of a first plurality of tokens can include a representation of the outcome of the event played against the first team (e.g., score) or other data associated with the event (e.g., statistics relating to the event, name of opponent, date the event was played), and/or each token of a second plurality of tokens can include a representation of the outcome of the postseason event by the first team (e.g., score) or other data associated with the event (e.g., statistics relating to the event, name of opponent, date the event was played).

While the team tracking kit 110 has been illustrated as including a first plurality of tokens 116 and a second plurality of tokens 118, a team tracking kit can include any suitable number of tokens that relate to the outcome of a season and/or postseason of a first team. Selection of a suitable number of tokens to include in a team tracking kit can be based on various considerations, including the outcome of a season of a first team and/or the outcome of a postseason of a first team. For example, a team tracking kit can include a first plurality of tokens, each token of the first plurality of tokens includes a representation of a team that is different than the representation of the first team and that the first team beat during an event and omit the inclusion of a second plurality of tokens. Alternatively, a team tracking kit can omit the inclusion of a first plurality of tokens and include a second plurality of tokens, each token of the second plurality of tokens includes a representation of the first team and a representation of a postseason title that the first team obtained.

A storage container included in a team tracking kit can have any suitable structural arrangement and be formed of any suitable material and selection of a suitable structural arrangement and material to form a storage container can be based on various considerations, including the number of elements within a team tracking kit. Examples of structural arrangements considered suitable to form a storage container include boxes, boxes that include a lid, boxes that include a lid attached to the box (e.g., pivotably attached), bags, and any other structural arrangement considered suitable for a particular embodiment. Examples of materials considered suitable to form a storage container include woods, metals, plastics, cardboard, fabrics, and any other material considered suitable for a particular embodiment. In the illustrated embodiment, the storage container 113 is a box 115 formed of a rigid plastic.

Figure 3:
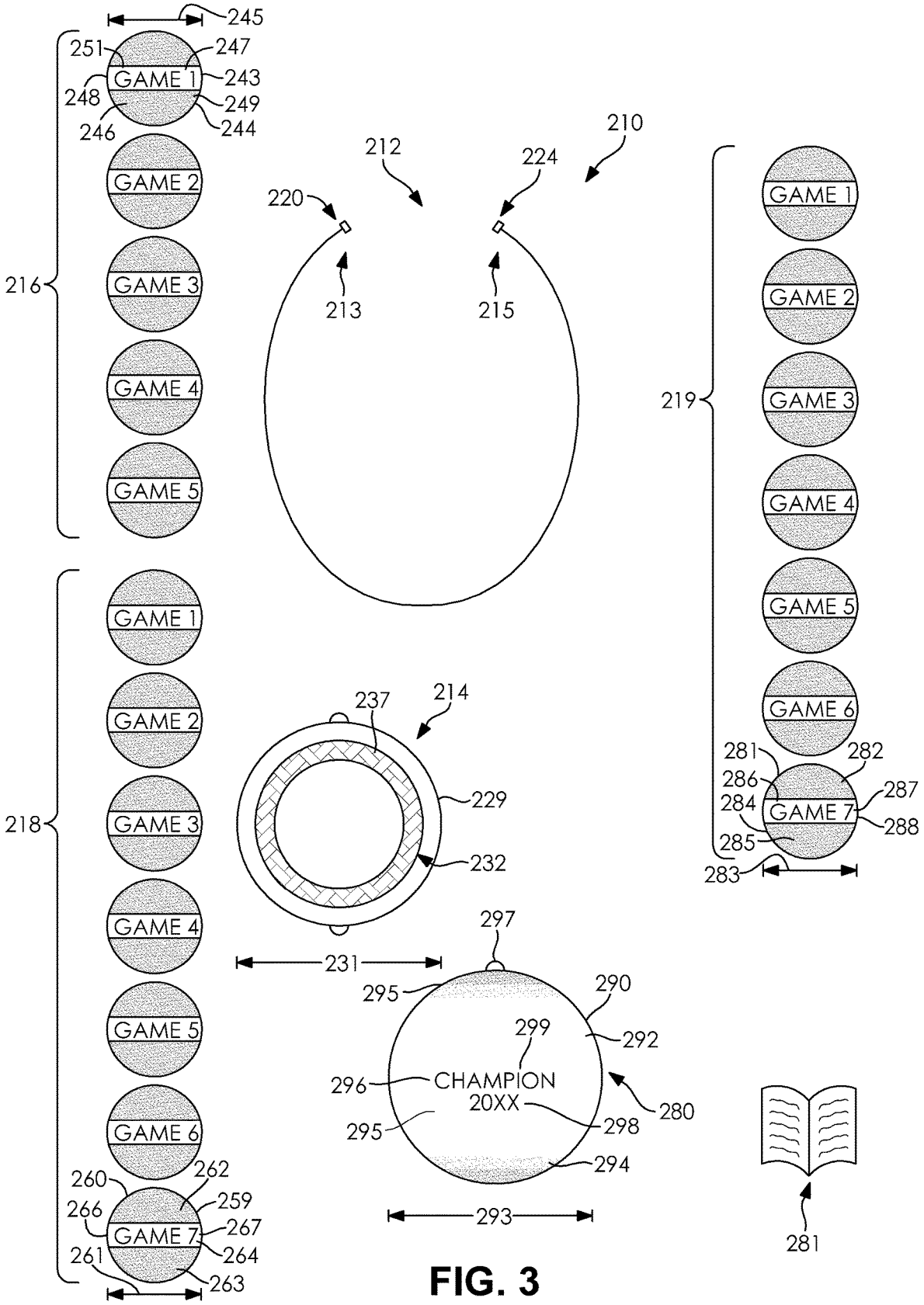
FIG. 3 is a top view of a third example team tracking kit.

FIG. 3 illustrates another team tracking kit 210. The team tracking kit 210 is similar to the team tracking kit 10 illustrated in FIG. 1 and described above, except as detailed below. The team tracking kit 210 includes an elongate member 212, a first token 214, a first plurality of tokens 216, a second plurality of tokens 218, a third plurality of tokens 219, a championship token 280, and instructions for use 281. In the illustrated embodiment, the team tracking kit 210 relates to a postseason within which a first team can be involved.

In the illustrated embodiment, the elongate member 212 includes a first magnet 213 and a second magnet 215 to accomplish attachment between the first end 220 of the elongate member 212 and the second end 222 of the elongate member 212.

In the illustrated embodiment, the first token 214 is formed as a disk 229, is attachable to the elongate member 212, is sized and configured such that it can be releasably disposed on the elongate member 212, and the representation of the first team 232 includes a combination of colors 237 associated with the first team.

In the illustrated embodiment, each token of the first plurality of tokens 216 is attachable to the elongate member 212, is formed as a disk 243, and is sized and configured such that it can be releasably disposed on the elongate member 212. Each token of the first plurality of tokens 216 has a main body 244, an outside diameter 245, a representation of the first team 246, a representation of an event within a first series within a postseason 247, and structure 248 for attaching the token to the elongate member 212. In the illustrated embodiment, the outside diameter 245 of each token of the first plurality of tokens 216 is less than the outside diameter 231 of the first token 214. Each token of the first plurality of tokens 216 has a representation of the first team 246 that is different than the representation of the first team 232 of the first token 214. However, alternative embodiments could include a representation of the first team included on a token of a first plurality of tokens that is the same as a representation of the first team included on a first token. The representation of the team 246 includes a combination of colors 249 associated with the first team and are configured differently than the combination of colors 237 of the first token 214. The representation of an event within a first series within a postseason 247 includes the event number 251 of the postseason event within the series (e.g., Division Finals, Game 1, Game 2, Game 3, Game 4, Game 5). For example, an event within which the first team can participate. Each token of the first plurality of tokens 216 includes a representation of an event within a first series within a postseason 247 that is distinct from the representations of an event within a first series within a postseason 247 included on the other tokens of the first plurality of tokens 216.

In the illustrated embodiment, each token of the second plurality of tokens 218 is attachable to the elongate member 212, is formed as a disk 259, and is sized and configured such that it can be releasably disposed on the elongate member 212. Each token of the second plurality of tokens 218 has a main body 260, an outside diameter 261, a representation of the first team 262, a representation of an event within a second series within a postseason 264, and structure 266 for attaching the token to the elongate member 212. In the illustrated embodiment, the outside diameter 261 of each token of the second plurality of tokens 218 is less than the outside diameter 231 of the first token 214 and greater than the outside diameter 245 of each token of the first plurality of tokens 216. Each token of the second plurality of tokens 218 has a representation of the first team 262 that is different than the representation of the first team 232 of the first token 214 and different than the representation of the first team 246 of each token of the second plurality of tokens 216. However, alternative embodiments could include a representation of the first team included on a token of a second plurality of tokens that is the same as a representation of the first team included on a first token and/or a representation of the first team included on a token of the first plurality of tokens. The representation of the team 262 includes a combination of colors 263 associated with the first team 263 and are configured differently than the combination of colors 237 of the first token 214 and the combination of colors 249 of each token of the first plurality of tokens 216. The representation of an event within a second series within a postseason 264 includes the event number 267 of the postseason event (e.g., Conference Finals, Game 1, Game 2, Game 3, Game 4, Game 5, Game 6, Game 7). Each token of the second plurality of tokens 218 includes a representation of an event within a second series within a postseason 264 that is distinct from the representations of an event within a second series within a postseason 264 included on the other tokens of the second plurality of tokens 218.

In the illustrated embodiment, each token of the third plurality of tokens 219 is attachable to the elongate member 212, is formed as a disk 281, and is sized and configured such that it can be releasably disposed on the elongate member 212. Each token of the third plurality of tokens 219 has a main body 282, an outside diameter 283, a representation of the first team 284, a representation of an event within a third series within a postseason 286, and structure 288 for attaching the token to the elongate member 212. In the illustrated embodiment, the outside diameter 283 of each token of the third plurality of tokens 219 is less than the outside diameter 231 of the first token 214 and greater than the outside diameter 261 of each token of the second plurality of tokens 218. Each token of the third plurality of tokens 219 has a representation of the first team 284 that is different than the representation of the first team 232 of the first token 214, the representation of the first team 246 of each token of the plurality of first tokens 216, and the representation of the first team 262 of each token of the second plurality of tokens 218. However, alternative embodiments could include a representation of the first team included on a token of a third plurality of tokens that is the same as a representation of the first team included on a first token, a token of the first plurality of tokens, and/or a token of the second plurality of tokens. The representation of the first team 284 includes a combination of colors 285 associated with the first team and are configured differently than the combination of colors 237 of the first token 214, the combination of colors 249 of each token of the first plurality of tokens 216, and the combination of colors 263 of each token of the second plurality of tokens 218. The representation of an event within a third series within a postseason 286 includes the event number 287 of the postseason event (e.g., Finals, Championships, Game 1, Game 2, Game 3, Game 4, Game 5, Game 6, Game 7). Each token of the third plurality of tokens 219 includes a representation of an event within a third series within a postseason 286 that is distinct from the representations of an event within a third series within a postseason 286 included on the other tokens of the third plurality of tokens 218.

In the illustrated embodiment, the championship token 280 is attachable to the first token 214, is formed as a disk 290, and is sized and configured such that it can be releasably disposed on the elongate member 212. The championship token 280 has a main body 292, an outside diameter 293, a representation of the first team 294, a representation of the season 295, a representation of the title 296, and structure 297 for attaching the championship token 280 to the first token 214. In the illustrated embodiment, the outside diameter 293 of the championship token 280 is greater than the outside diameter 231 of the first token 214. The championship token 280 has a representation of the first team 294 that is the same as the representation of the first team 232 of the first token 214. However, alternative embodiments could include a representation of the first team on a first token and a representation of a first team on a championship token that are different from one another. In the illustrated embodiment, the representation of the first team 294 includes a combination of colors 295 associated with the first team and are configured the same as than the combination of colors 237 of the first token 214. The representation of the season 295 includes a representation of a year 298 and the representation of the title 296 is associated with the postseason and includes the title 299 that represents the winner of the postseason (e.g., first team, champions).

While the team tracking kit 210 has been illustrated as including a first plurality of tokens 216, a second plurality of tokens 218, a third plurality of tokens 219, and a championship token 280, a team tracking kit can include any suitable number of a plurality of tokens and championship tokens. Selection of a suitable number of a plurality of tokens and championship tokens to include in a team tracking kit can be based on various considerations, such as the number of series included in a postseason and/or championship. Examples of suitable numbers of tokens, or plurality of tokens, to include in a team tracking kit include one, at least one, two, a plurality, three, four, five, and any other number considered suitable for a particular embodiment.

Optionally, a team tracking kit can include a series token that includes a representation of a victory in a particular series within a postseason (e.g., division series, conference series). A series token can have any suitable structural arrangement, such as those described herein with respect to a first token or a token within a plurality of tokens, and can include a representation of a victory in a particular series within a postseason using any suitable method or technique, such as those described herein with respect to including a representation of a first team and/or rival team on a token.

The instructions for use 281 can include any suitable information that provides a user of the team tracking kit with information relating how to use the kit (e.g., position a token on an elongate member), to track a team and/or a rival team, and/or to use a kit, as described in more detail herein.

Figure 4:
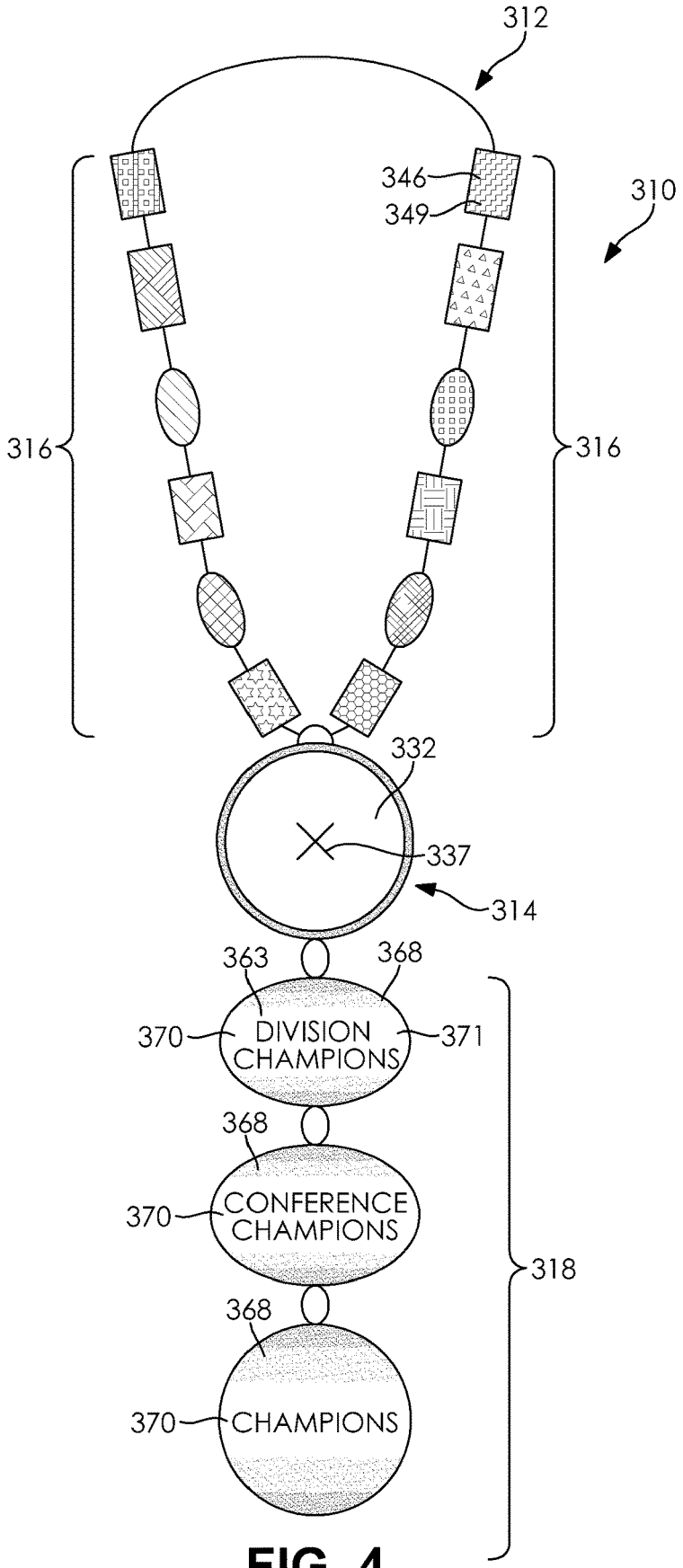
FIG. 4 is a top view of a fourth example team tracking kit.

FIG. 4 illustrates another team tracking kit 310. The team tracking kit 310 is similar to the team tracking kit 210 illustrated in FIG. 3 and described above, except as detailed below. The team tracking kit 310 includes an elongate member 312, a first token 314, a first plurality of tokens 316, and a second plurality of tokens 318. In the illustrated embodiment, the team tracking kit 310 relates to the outcome of a season and postseason of a first team and is pre-assembled such that each token (e.g., first token 314, each token of the first plurality of tokens 316, each token of the second plurality of tokens 318) is attached to the elongate member 312.

In the illustrated embodiment, the first token 314 includes a representation of a first team 332, each token of the first plurality of tokens 316 includes a representation of a rival team 346 that is different than the representation of the first team 332 and that the first team beat during an event in the season, and each token of the second plurality of tokens 318 includes a representation of the first team 368 and a representation of a postseason title 370 that the first team obtained in the postseason. In the illustrated embodiment, the representation of the first team 332 is a logo 337 of the first team, the representation of a rival team 346 included on each token of the first plurality of tokens 316 includes a combination of colors 349 associated with a team that the first team has encountered during a single season and beat during an event, the representation of the first team 368 includes a combination of colors 363 associated with the first team, and the representation of a postseason title 370 includes the name 371 of the postseason title.

Since the team tracking kit 310 relates to the outcome of a season and postseason of a first team, additional representations of information can be provided on any token. For example, a first token can include a representation of the first team's overall record during the season and/or postseason, each token of a first plurality of tokens can include a representation of the outcome of the event played against the first team (e.g., score) or other data associated with the event (e.g., statistics relating to the event, name of opponent, date the event was played), and/or each token of a second plurality of tokens can include a representation of the outcome of the postseason event by the first team (e.g., score) or other data associated with the event (e.g., statistics relating to the event, name of opponent, date the event was played).

Figure 5:
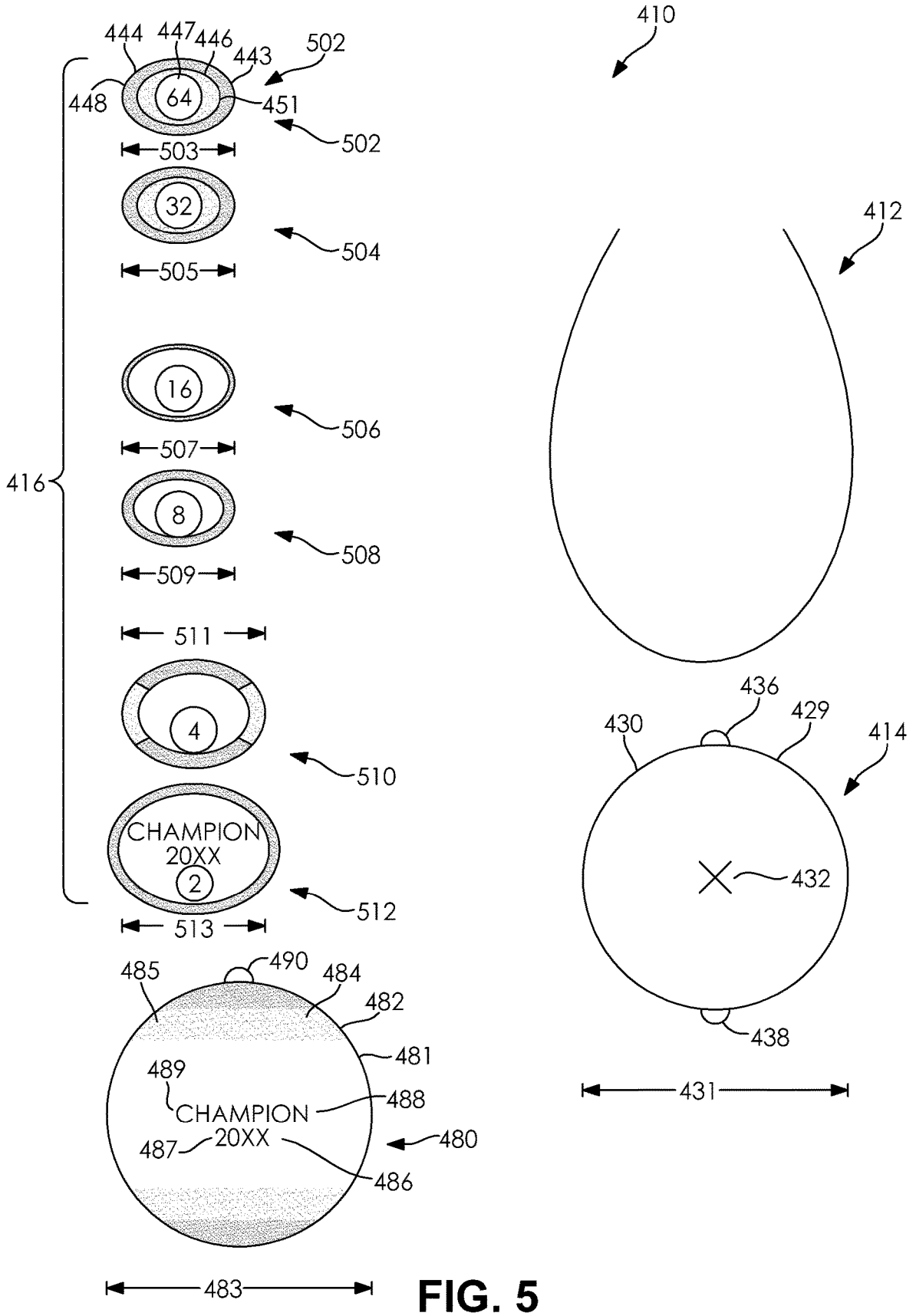
FIG. 5 is a top view of a fifth example team tracking kit.

FIG. 5 illustrates another team tracking kit 410. The team tracking kit 410 is similar to the team tracking kit 210 illustrated in FIG. 3 and described above, except as detailed below. The team tracking kit 410 includes an elongate member 412, a first token 414, a first plurality of tokens 416, and a championship token 480. In the illustrated embodiment, the team tracking kit 410 relates to a tournament within which a first team can be involved.

In the illustrated embodiment, the first token 414 is attachable to the elongate member 412, is formed as a disk 429, and is sized and configured such that it can be releasably disposed on the elongate member 412. The first token has a main body 430, an outside diameter 431, a representation of a first team 432, structure 436 for attaching the first token 414 to the elongate member 412, and structure 438 for attaching the championship token 480 to the first token 414. In the illustrated embodiment, the representation of the first team 432 includes the logo 437 associated with the first team.

In the illustrated embodiment, each token of the first plurality of tokens 416 is attachable to the elongate member 412, is formed as a disk 443, and is sized and configured such that it can be releasably disposed on the elongate member 412. Each token of the first plurality of tokens 416 has a main body 444, a representation of the first team 446, a representation of a distinct event (e.g., round) within a tournament 447, and structure 448 for attaching the token to the elongate member 412. Each token of the first plurality of tokens 416 has a representation of the first team 446 that is different than the representation of the first team 432 of the first token 414. In the illustrated embodiment, the representation of the team 446 includes a combination of colors 451 associated with the first team. The representation of a distinct event within a tournament 447 includes the number of teams within the tournament of at the level of the tournament designated by the token (e.g., first round, second round, third round, fourth round, fifth round, sixth round, seventh round, etc.). For example, an event (e.g., sporting event, game) within which the first team can participate. In alternative embodiments, however, other representations can be included on each token, such as those described herein (e.g., representation of a season, representation of a year, level of the tournament). A first token 502 of the first plurality of tokens 416 includes a representation of an event within a tournament 447 that represents the sixty-four teams that are in the tournament and has a first outside diameter 503. A second token 504 of the first plurality of tokens 416 includes a representation of an event within a tournament 447 that represents the thirty-two teams that are in the tournament and has a second outside diameter 505 that is greater than the first outside diameter 503. A third token 506 of the first plurality of tokens 416 includes a representation of an event within a tournament 447 that represents the sixteen teams that are in the tournament and has a third outside diameter 507 that is greater than the second outside diameter 505. A fourth token 508 of the first plurality of tokens 416 includes a representation of an event within a tournament 447 that represents the eight teams that are in the tournament and has a fourth outside diameter 509 that is greater than the third outside diameter 507. A fifth token 510 of the first plurality of tokens 416 includes a representation of an event within a tournament 447 that represents the four teams that are in the tournament and has a fifth outside diameter 511 that is greater than the fourth outside diameter 509. A sixth token 504 of the first plurality of tokens 416 includes a representation of an event within a tournament 447 that represents the two teams that are in the tournament (e.g., finals) and has a sixth outside diameter 513 that is greater than the fifth outside diameter 511. In addition, the sixth token includes a representation of the title of the event within the tournament 512 (e.g., championship). Therefore, each token of the first plurality of tokens 416 has an outside diameter that is different from the other tokens of the first plurality of tokens 416.

In the illustrated embodiment, the championship token 480 is attachable to the first token 414, is formed as a disk 481, and is sized and configured such that it can be releasably disposed on the elongate member 412. The championship token 480 has a main body 482, an outside diameter 483, a representation of a first team 484, a representation of a season 486, a representation of a title 488, and structure 490 for attaching the championship token 480 to the first token 414. In the illustrated embodiment, the outside diameter 483 of the championship token 480 is greater than the outside diameter 445 of each token of the first plurality of tokens 416 and the outside diameter 431 of the first token 414. The championship token 480 has a representation of the first team 484 that is the same as the representation of the first team 446 included on each token of the first plurality of tokens 416. In the illustrated embodiment, the representation of the first team 484 includes a combination of colors 485 associated with the first team and is configured the same as the combination of colors 451 of each token of the first plurality of tokens 416. The representation of the season 486 includes a representation of a year 487 and the representation of a title 488 includes a representation of a title 489 of the first team (e.g., champions).

Figure 6:
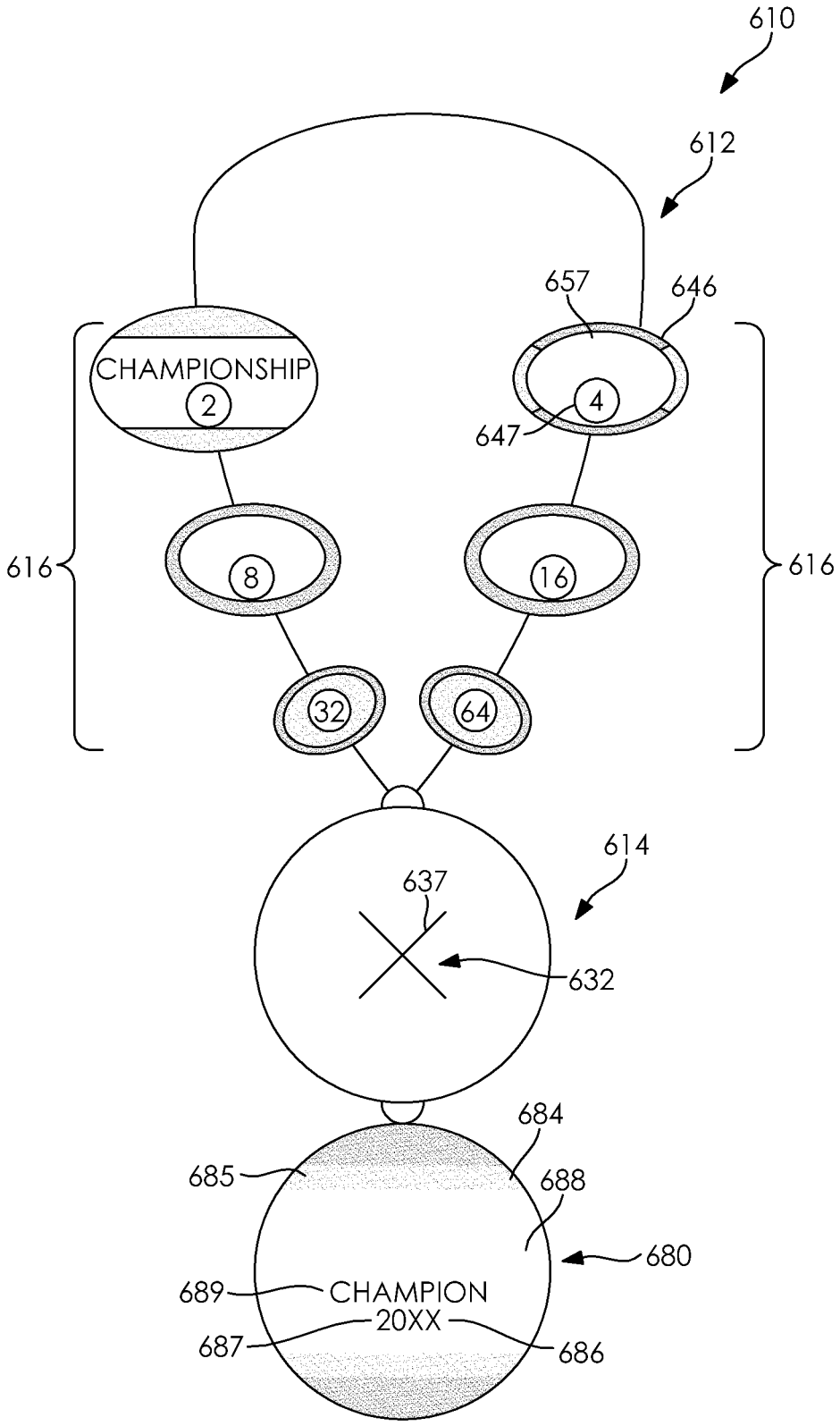
FIG. 6 is a top view of a sixth example team tracking kit.

FIG. 6 illustrates another team tracking kit 610. The team tracking kit 610 is similar to the team tracking kit 410 illustrated in FIG. 5 and described above, except as detailed below. The team tracking kit 610 includes an elongate member 612, a first token 614, a first plurality of tokens 616, and a championship token 680. In the illustrated embodiment, the team tracking kit 610 relates to the outcome of a tournament within which a first team competed.

In the illustrated embodiment, the first token 614 includes a representation of a first team 632, each token of the first plurality of tokens 616 includes a representation of the first team 646 and a representation of a distinct event (e.g., round) within a tournament 647 that the first team was victorious, and the championship token 680 includes a representation of a first team 684, a representation of a season 686, a representation of a title 688 that the first team obtained. In the illustrated embodiment, the representation of the first team 632 is a logo 637 of the first team, the representation of the first team 646 includes a combination of colors 651 associated with the first team, the representation of a distinct event (e.g., round) within a tournament 647 that the first team was victorious included on each token of the first plurality of tokens 616 includes the number of teams within the tournament of at the level of the tournament designated by the token, the representation of the first team 684 includes a combination of colors 685 associated with the first team, the representation of a season 686 includes a representation of a year 687 and the representation of a title 688 includes a representation of a title 689 of the first team (e.g., champions) at the end of the tournament.

Since the team tracking kit 610 relates to the outcome of a tournament within which a first team competed, additional representations of information can be provided on any token. For example, a first token can include a representation of the first team's overall record during the season and/or postseason, each token of a first plurality of tokens can include a representation of the outcome of the event played against the first team (e.g., score) or other data associated with the event (e.g., statistics relating to the event, name of opponent, date the event was played), and/or each token of a second plurality of tokens can include a representation of the outcome of the postseason event by the first team (e.g., score) or other data associated with the event (e.g., statistics relating to the event, name of opponent, date the event was played).

Optionally, a team tracking kit can include one or more clinching tokens, each of which includes a representation of data relating to a specific event within which the first team clinched a title, series, or event. A clinching token can have any suitable structural arrangement, such as those described herein with respect to a first token or a token within a plurality of tokens, and can include a representation of data relating to a specific event within which the first team clinched a title, series, or event using any suitable method or technique, such as those described herein with respect to including a representation of a first team and/or rival team on a token.

Methods of using a team tracking kit and methods of providing a team tracking kit are described herein. While the methods described herein are shown and described as a series of acts, it is to be understood and appreciated that the methods are not limited by the order of acts, as some acts may in accordance with these methods, occur in different orders, and/or concurrently with other acts described herein.

Figure 7:
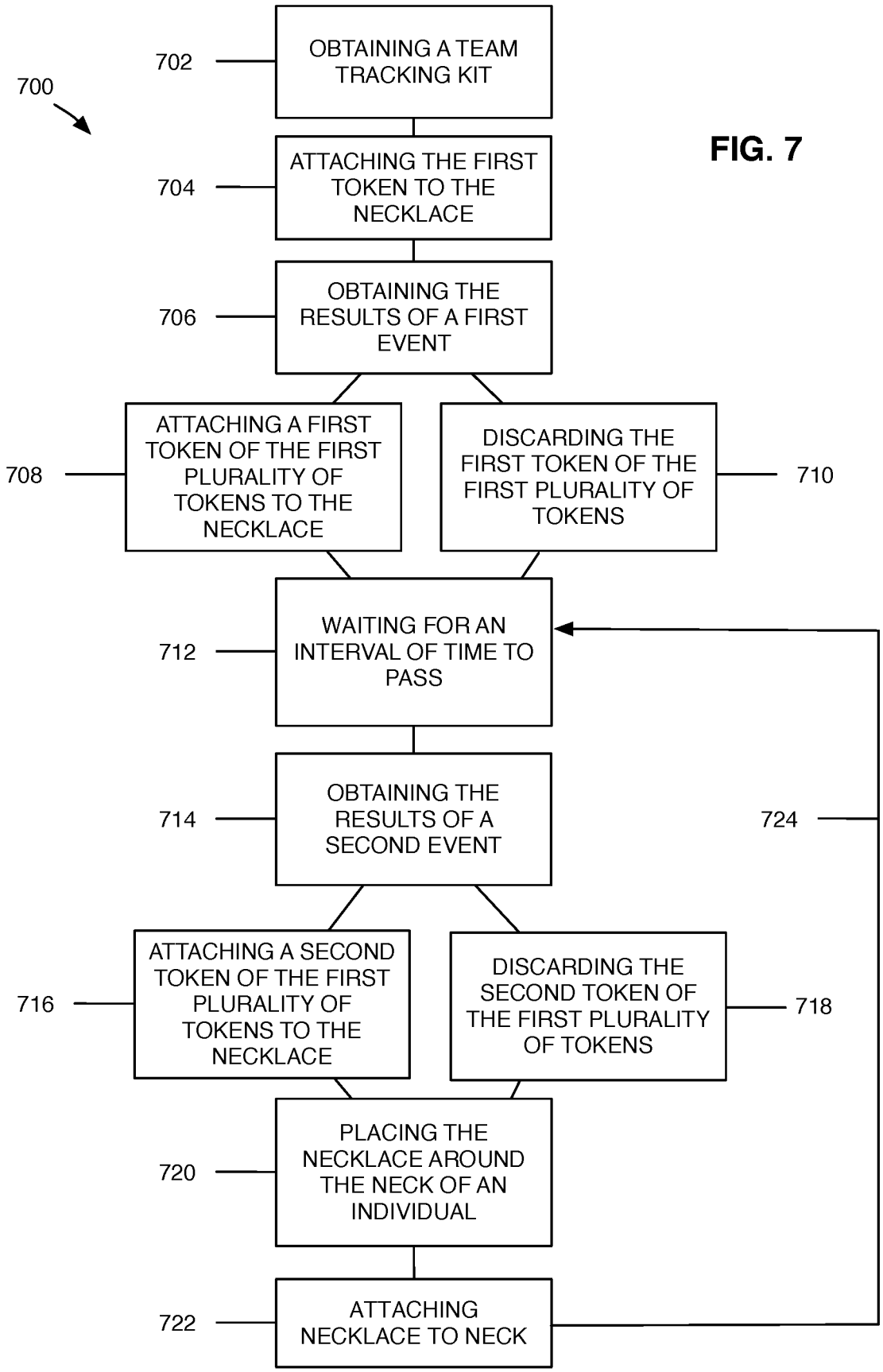
FIG. 7 is a schematic illustration of an example method of using a team tracking kit.

FIG. 7 is a schematic illustration of a method 700 of using a team tracking kit.

An initial step 702 comprises obtaining a team tracking kit. The team tracking kit includes an elongate member, a first token, and a first plurality of tokens. Another step 704 comprises attaching the first token to the elongate member. Another step 706 comprises obtaining the results of a first event within which the first team was involved. If the first team won the first event, another step comprises 708 attaching a first token of the first plurality of tokens to the elongate member. If the first team lost the first event, another step 710 comprises discarding the first token of the first plurality of tokens. Another step 712 comprises waiting for an interval of time to pass. Another step 714 comprises obtaining the results of second event within which the first team was involved. If the first team won the second event, another step 716 comprises attaching a second token of a first plurality of tokens to the elongate member. If the first team lost the second event, another step 718 comprises discarding the second token of the first plurality of tokens. Another step 720 comprises placing the elongate member around the neck of an individual. Another step 722 comprises attaching the elongate member to the individual. Another step 724 comprises repeating one or more steps.

Step 702 can be accomplished by obtaining any suitable team tracking kit and selection of a suitable team tracking kit can be based on various considerations, such as the first team intended to be tracked using the method. Examples of team tracking kits considered suitable to use in a method of using a team tracking kit include team tracking kit 10, team tracking kit 210, team tracking kit 410, variations of the team tracking kits described herein, and any other team tracking kit considered suitable for a particular embodiment. A team tracking kit included in method 700 can include any suitable number of tokens, or plurality of tokens, that include any suitable representation of a first team, rival team, or other representations, such as those described herein. Examples of a suitable plurality of tokens to include in a method of using a team tracking kit include a first plurality of tokens, a second plurality of tokens, a third plurality of tokens, variations of the plurality of tokens described herein, and any other token, or plurality of tokens, considered suitable for a particular embodiment.

Step 704 can be accomplished by applying a force on the first token that is directed towards an end of the elongate member (e.g., first end, second end) such that the structure for attaching the first token to the elongate member comes into contact with the elongate member and the first token becomes attached to the elongate member. For example, in embodiments in which the first token defines a passageway, a force can be placed on the first token that directed towards an end of the elongate member (e.g., first end, second end) such that the elongate member is passed through the passageway defined by the first token and the first token becomes attached to the elongate member. Alternatively, step 704 can be omitted from method 700 and a first token can be pre-assembled on an elongate member such that it is disposed on the elongate member.

Step 706 can be accomplished using any suitable technique or method of obtaining a score of a first event and selection of a suitable technique or method to obtain a score of a first event can be based on various considerations, such as the techniques or methods available to a user. Examples of techniques and methods of obtaining the results of a first event considered suitable include viewing the first event, reviewing the results of the first event via an online resource, newspaper, or magazine, or any other technique or method considered suitable for a particular embodiment.

Step 708 can be accomplished as described with respect to step 704, but with respect to a token of the first plurality of tokens.

Step 710 can be accomplished by using any suitable technique or method of discarding a token, such as by throwing the token in the trash, simply electing not to use it with the necklace, or any other technique or method considered suitable for a particular embodiment. Alternatively, step 710 can be omitted from method 700 and the token can be used in any manner desired by a user of the team tracking kit.

Step 712 can be accomplished by completing step 708 or step 710 and waiting for an interval of time to pass before completing step 712, 714, 716, 718, 720, 722, or any other step being completed in method 700. Any interval of time is considered suitable and selection of a suitable interval of time can be based on various considerations, including the event being tracked by a user. Examples of intervals of time considered suitable include allowing one or more seconds, one or more minutes, one or more hours, one or more days, one or more weeks, and/or one or more months to pass.

Step 714 can be accomplished as described with respect to step 706, but with respect to a second team. Step 716 can be accomplished as described with respect to step 708, but with respect to a second token of the first plurality of tokens. Step 718 can be accomplished as described with respect to step 710, but with respect to a second token of the first plurality of tokens.

Step 720 can be accomplished by applying a force on the elongate member directed around, or over, the neck of an individual until the elongate member becomes disposed around the individual's neck. Optionally, step 720 can be omitted from method 700 in embodiments in which the elongate member is formed as an adornment that is worn on a different part of an individual's body. For example, an alternative to step 720 comprises applying a force on the elongate member directed around, or over, a portion of an individual's body (e.g., neck, wrist, finger) until the elongate member becomes disposed around the portion of the individual's body. Optionally, step 720 can be accomplished subsequent to step 704, subsequent to step 704 and before step 706, subsequent to step 708 or 710, and/or subsequent to step 708 or 710 and before step 712.

Step 722 can be accomplished by attaching a first portion of the elongate member to a second portion of the elongate member, as described herein. Optionally, step 722 can be omitted from method 700 in embodiments in which the elongate member is formed as a single continuous piece of material.

As shown in step 724, each of steps 712, 714, 716, 718, 720, and/or step 722 can be repeated with respect to any suitable number of tokens within a first plurality of tokens, a second plurality of tokens, and/or third plurality of tokens and the repetition of these steps will be based on the outcome of an event, the number of events within a season, and/or the number of events within a postseason. Optionally, step 724 can be omitted from method 700.

Figure 8:
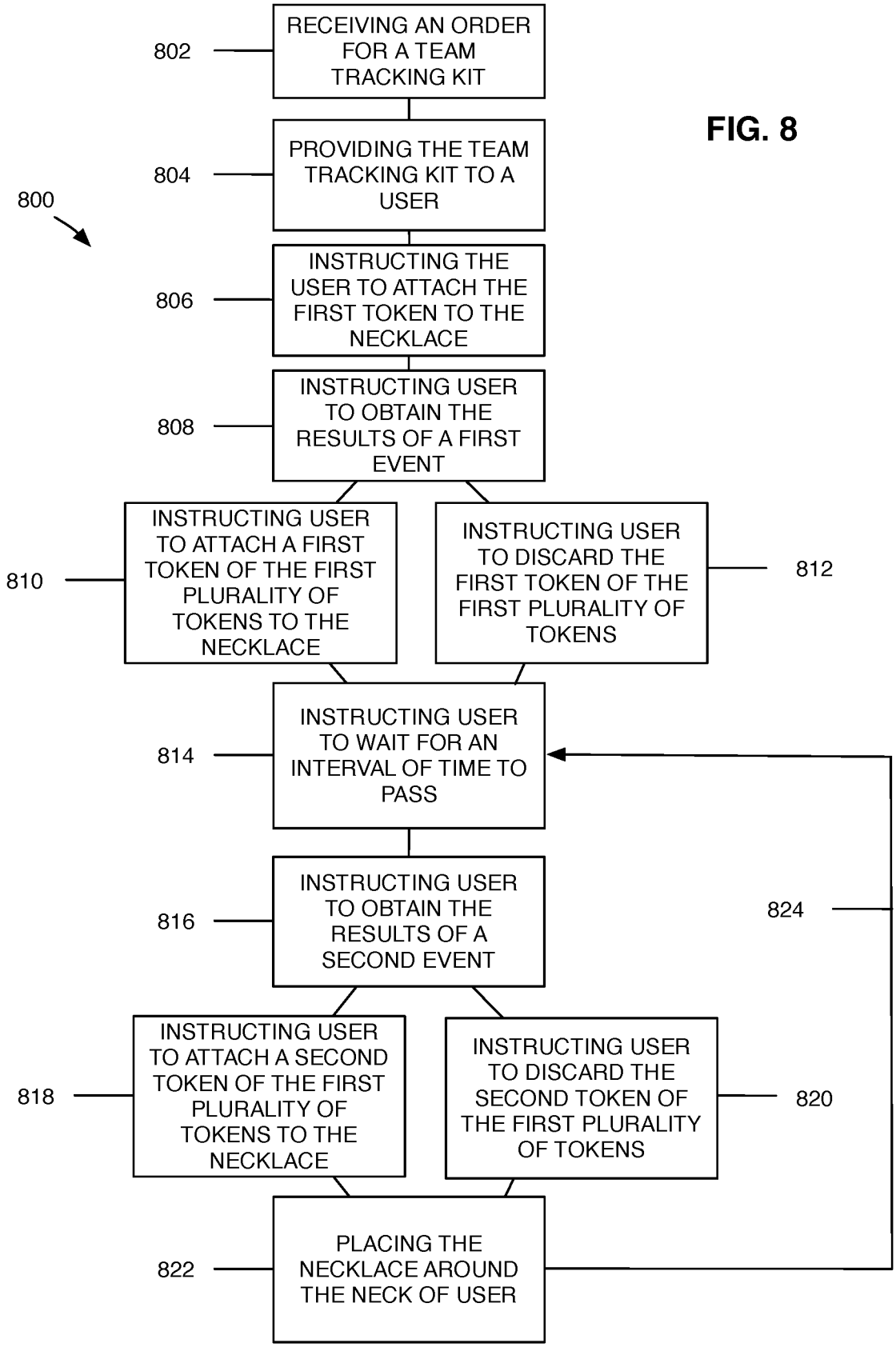
FIG. 8 is a schematic illustration of an example method of providing a team tracking kit.

FIG. 8 is a schematic illustration of a method 800 of providing a team tracking kit.

An initial step 802 comprises receiving an order to purchase a team tracking kit. The team tracking kit includes an elongate member, a first token, and a first plurality of tokens. Another step 804 comprises providing the team tracking kit to a user. Another step 806 comprises instructing the user to attach the first token to the elongate member. Another step 808 comprises instructing the user to obtain the results of a first event within which the first team was involved. If the first team won the first event, another step 810 comprises instructing the user to add a first token of the first plurality of tokens to the elongate member. If the first team lost the first event, another step 812 comprises instructing the user to discard the first token of the first plurality of tokens. Another step 814 comprises instructing the user to wait for an interval of time to pass. Another step 816 comprises instructing the user to obtain the results of a second event within which the first team was involved. If the first team won the second event, another step 818 comprises instructing the user to add a second token of the first plurality of tokens to the elongate member. If the first team lost the second event, another step 820 comprises instructing the user to discard the second token of the first plurality of tokens. Another step 822 comprises placing the elongate member around the neck of an individual. Another step 824 comprises repeating one or more steps.

Step 802 can be accomplished using any suitable technique or method of receiving an order for a team tracking kit and selection of a suitable technique and method to receive an order for a team tracking kit can be based on various considerations, such as the number of team tracking kits being ordered. Examples of suitable techniques and methods of receiving an order for a team tracking kit include using a network (e.g., internet), an application, an order form, a phone call, verbally, in-person in a retail setting, and any other technique or method considered suitable for a particular embodiment. Step 802 can be accomplished prior to, or subsequent to, the start of a season, postseason, or tournament.

Step 804 can be accomplished using any suitable technique or method of providing a team tracking kit to a user and selection of a suitable technique and method to provide a team tracking kit to a user can be based on various considerations, such as the number of team tracking kits being ordered. Examples of suitable techniques and methods of providing a team tracking kit include using a courier, mail, hand delivery, and any other technique or method considered suitable for a particular embodiment.

Step 804 can be accomplished by providing any suitable team tracking kit and selection of a suitable team tracking kit can be based on various considerations, such as the first team intended to be tracked. Examples of team tracking kits considered suitable to provide and use in a method of providing a team tracking kit include team tracking kit 10, team tracking kit 210, team tracking kit 410, variations of the team tracking kits described herein, and any other team tracking kit considered suitable for a particular embodiment. A team tracking kit included in method 800 can include any suitable number of tokens, or plurality of tokens, that include any suitable representation of a first team, rival team, or other representations, such as those described herein. Examples of a suitable plurality of tokens to include in a method of providing a team tracking kit include a first plurality of tokens, a second plurality of tokens, a third plurality of tokens, variations of the plurality of tokens described herein, and any other token, or plurality of tokens, considered suitable for a particular embodiment.

Step 806 can be accomplished by instructing a user as described with respect to step 704. Step 808 can be accomplished by instructing a user as described with respect to step 706. Step 810 can be accomplished by instructing a user as described with respect to step 708. Step 812 can be accomplished by instructing a user as described with respect to step 710. Step 814 can be accomplished by instructing a user as described with respect to step 712. Step 816 can be accomplished by instructing a user as described with respect to step 714. Step 818 can be accomplished by instructing a user as described with respect to step 716. Step 820 can be accomplished by instructing a user as described with respect to step 718. Step 822 can be accomplished by instructing a user as described with respect to step 720.

Optionally, step 822 can be accomplished subsequent to step 806, subsequent to step 806 and before step 808, subsequent to step 810 or 812, and/or subsequent to step 810 or 812 and before step 814.

As shown in step 824, each of steps 814, 816, 818, 820, and/or step 822 can be repeated with respect to any suitable number of tokens within a first plurality of tokens, a second plurality of tokens, and/or third plurality of tokens and the repetition of these steps will be based on the outcome of an event, the number of events within a season, and/or the number of events within a postseason. Optionally, step 824 can be omitted from method 700.

Those with ordinary skill in the art will appreciate that various modifications and alternatives for the described and illustrated embodiments can be developed in light of the overall teachings of the disclosure. Accordingly, the particular arrangements disclosed are intended to be illustrative only and not limiting as to the scope of the invention, which is to be given the full breadth of the appended claims and any and all equivalents thereof.

What is claimed is:

1. A method of using a team tracking kit comprising:

obtaining a team tracking kit, the team tracking kit comprising:

an elongate member;

a first token attachable to the elongate member and including a representation of a first team; and a first plurality of beads, each bead of the first plurality of beads attachable to the elongate member and including a representation of a rival team that is different than the representation of the first team;

attaching the first token to the elongate member;

obtaining the results of a first event within which the first team was involved;

attaching a first bead of the first plurality of beads to the elongate member if the first team won the first event;

waiting for an interval of time to pass;

obtaining the results of a second event within which the first team was involved; and attaching a second bead of the first plurality of beads to the elongate member if the first team won the second event;

wherein the team tracking kit includes a plurality of medallions, each medallion of the plurality of medallions attachable to the first token and including a representation of the first team and a representation of a postseason title.

2. The method of claim 1, wherein each medallion in the plurality of medallions has an outside diameter that is different than the other medallions within the plurality of medallions.

3. The method of claim 1, further comprising placing the elongate member around a neck of an individual.

4. The method of claim 3, further comprising attaching the elongate member to the individual.

5. The method of claim 1, further comprising discarding the first bead of the first plurality of beads if the first team lost the first event.

6. The method of claim 1, further comprising discarding the second bead of the first plurality of beads if the first team lost the second event.

7. The method of claim 1, wherein the interval of time comprises one or more days.

8. The method of claim 1, wherein each bead of the first plurality of beads has a distinct representation of a rival team relative to the other beads of the first plurality of beads.

9. The method of claim 1, wherein the representation of the first team is selected from the group consisting of a moniker, a logo, a color, and a combination of colors; and wherein the representation of the rival team is selected from the group consisting of a moniker, a logo, a color, and a combination of colors.

10. The method of claim 1, wherein each bead in a first set of beads of the first plurality of beads is formed as an ovoid bead and each bead in a second set of beads of the first plurality of beads is formed as a tubular bead.

11. The method of claim 1, wherein the first token has a first outside diameter and each bead of the first plurality of beads has a second outside diameter that is different than the first outside diameter.

12. A method of using a team tracking kit comprising:

obtaining a team tracking kit, the team tracking kit comprising:

an elongate member;

a first token disposed on the elongate member and including a representation of a first team;

a first plurality of beads, each bead of the first plurality of beads attachable to the elongate member and including a representation of a rival team that is different than the representation of the first team; and a plurality of medallions, each medallion of the plurality of medallions attachable to the first token and including a representation of the first team and a representation of a postseason title;

obtaining the results of a first event within which the first team was involved;

attaching a first bead of the first plurality of beads to the elongate member if the first team won the first event;

discarding the first bead of the first plurality of beads if the first team lost the first event;

waiting for an interval of time to pass;

obtaining the results of a second event within which the first team was involved;

attaching a second bead of the first plurality of beads to the elongate member if the first team won the second event; and discarding the second bead of the first plurality of beads if the first team lost the second event.

13. The method of claim 12, further comprising placing the elongate member around a neck of an individual.

14. The method of claim 13, further comprising attaching the elongate member to the individual.

15. The method of claim 12, wherein each bead of the first plurality of beads has a distinct representation of a rival team relative to the other beads of the first plurality of beads.

16. The method of claim 12, wherein the representation of the first team is selected from the group consisting of a moniker, a logo, a color, and a combination of colors; and wherein the representation of the rival team is selected from the group consisting of a moniker, a logo, a color, and a combination of colors.

17. The method of claim 12, wherein the first token has a first outside diameter and each bead of the first plurality of beads has a second outside diameter that is different than the first outside diameter.

18. The method of claim 12, wherein each medallion in the plurality of medallions has an outside diameter that is different than the other medallions within the plurality of medallions.

* * * * *